US010618319B2

(12) United States Patent
Sakaki et al.

(10) Patent No.: US 10,618,319 B2
(45) Date of Patent: Apr. 14, 2020

(54) DRYING DEVICE, NON-TRANSITORY COMPUTER READABLE MEDIUM FOR DRYING AND IMAGE FORMING APPARATUS

(71) Applicant: FUJI XEROX CO., LTD., Tokyo (JP)

(72) Inventors: Shigeyuki Sakaki, Ebina (JP); Chikaho Ikeda, Ebina (JP); Akira Sakamoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/149,217

(22) Filed: Oct. 2, 2018

(65) Prior Publication Data

US 2019/0308422 A1 Oct. 10, 2019

(30) Foreign Application Priority Data

Apr. 5, 2018 (JP) ..... 2018-073394

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 9,321,282 | B2 * | 4/2016 | Isozaki | B41J 11/002 |
| 2004/0141040 | A1 | 7/2004 | Nakajima | |
| 2015/0158311 | A1 | 6/2015 | Ogasawara et al. | |
| 2018/0001667 | A1 | 1/2018 | Ikeda et al. | |

FOREIGN PATENT DOCUMENTS

| | | |
|---|---|---|
| JP | 2004-188891 | 7/2004 |
| JP | 2015-112792 | 6/2015 |
| JP | 2018-001556 | 1/2018 |

* cited by examiner

*Primary Examiner* — Lamson D Nguyen
(74) *Attorney, Agent, or Firm* — Fildes & Outland, P.C.

(57) ABSTRACT

There is provided a drying device. Laser elements control energies of laser beams to be radiated, and radiates laser beams onto predetermined regions of an image, respectively. A controller controls average irradiation energy of laser beams by calculating printing rates for plural types of divided patterns with respect to the regions of the image, and calculating energy required to dry, for each divided pattern, based on the printing rates calculated for individual divided patterns, and selecting energy to be adopted according to a purpose, from the energy calculated for the individual divided patterns.

20 Claims, 13 Drawing Sheets

A1

| | | |
|---|---|---|
| (a1) 1.5 | (a2) 1.5 | (a3) 2.5 |
| (a4) 1.5 | (a5) 3.0 | (a6) 1.5 |
| (a7) 1.5 | (a8) 2.0 | (a9) 1.5 |

(i) FOR EACH PIXEL OF SMALL PIXELS a1, a2, a4, a6, a7, and a9, LASER ENERGY SET FOR LARGE PIXEL IS ADOPTED (ii) FOR EACH PIXEL OF SMALL PIXELS a3, a5, and a8, LASER ENERGY SET FOR CORRESPONDING SMALL PIXEL IS ADOPTED

DETERMINE LASER ENERGY USING CHARACTERISTIC CURVE OF EACH REGION

DRYING DEVICE, NON-TRANSITORY COMPUTER READABLE MEDIUM FOR DRYING AND IMAGE FORMING APPARATUS

CROSS-REFERENCE TO RELATED APPLICATIONS

This application is based on and claims priority under 35 USC 119 from Japanese Patent Application No. 2018-73394 filed Apr. 5, 2018.

BACKGROUND

Technical Field

The present disclosure relates to a drying device, a non-transitory computer readable medium, and an image forming apparatus.

Related Art

Patent Literature 1 discloses a technology for using maximum laser power by performing fitting with accumulative energy and overlapping patterns arranged in a sheet conveyance direction.

Patent Literature 2 discloses an ultraviolet-curing inkjet apparatus which controls an ultraviolet radiation source such that the intensity of irradiation with ultraviolet light is maintained even if the printing speed changes.

Patent Literature 3 discloses a technology for controlling the time for laser light irradiation in view of the types of recording media, the printing speed, and the interval from printing to laser irradiation.

[Patent Literature 1] Japanese Patent Application Laid-Open No. 2018-001556

[Patent Literature 2] Japanese Patent Application Laid-Open No. 2004-188891

[Patent Literature 3] Japanese Patent Application Laid-Open No. 2015-112792

SUMMARY

In the case of controlling average irradiation energy in view of the printing rate, paper wrinkling (hereinafter, also referred to simply as wrinkling) may occur due to swelling and contracting of non-image sections and image sections.

Aspects of non-limiting embodiments of the present disclosure relate to obtain a drying device, a drying program, and an image forming apparatus capable of reducing paper wrinkling when irradiating droplets on a recording medium with laser light to dry the droplets, as compared to the case of irradiating them with laser light at irradiation intensity set without considering the image printing rate and pattern size.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a drying device including: plural laser elements that controls energies of laser beams to be radiated, and radiates laser beams onto predetermined regions of an image, respectively; and a controller that controls average irradiation energy of laser beams by calculating printing rates for plural types of divided patterns with respect to the regions of the image, and calculating energy required to dry, for each divided pattern, based on the printing rates calculated for individual divided patterns, and selecting energy to be adopted according to a purpose, from the energy calculated for the individual divided patterns.

BRIEF DESCRIPTION OF THE DRAWINGS

Exemplary embodiments of the present invention will be described in detail based on the following figures, wherein:

FIG. 6A is a front view illustrating continuous form paper P showing experiment object patterns, and FIG. 6B is a view illustrating wrinkling grade evaluation characteristics which are obtained by drying the individual patterns with different laser energies;

FIG. 11A is a plan view illustrating continuous form paper P divided into regions having different sizes (a large region, a small region, and minimum regions), and FIG. 11B shows characteristic curves illustrating the relationships between Cin and laser energy in individual regions;

DETAILED DESCRIPTION (Configuration of Inkjet Recording Apparatus 10)

Figure 1A:
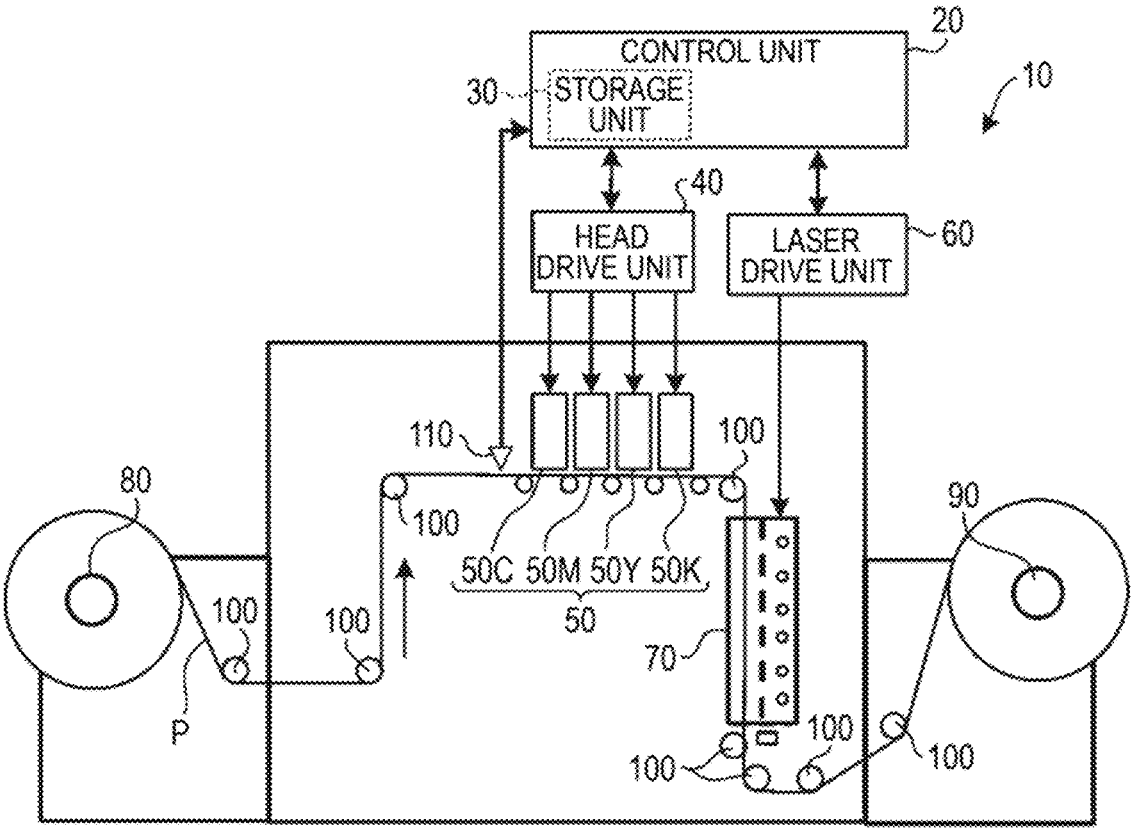
FIGS. 1A and 1B are schematic configuration diagrams illustrating an example of a main configuration part of an inkjet recording apparatus.

FIG. 1 is a schematic configuration diagram of an inkjet recording apparatus 10 according to the present exemplary embodiment.

The inkjet recording apparatus 10 includes, for example, a control unit 20 which is an example of a control means, a storage unit 30, a head drive unit 40, printing heads 50, a laser drive unit 60, a laser drying device 70, a paper feeding roller 80, a discharging roller 90, conveying rollers 100, a paper speed detection sensor 110, and so on.

The control unit 20 controls rotation of the conveying rollers 100 connected to a paper conveyance motor (not shown in the drawings) via a mechanism such as gears and so on, by driving the paper conveyance motor. On the paper feeding roller 80, continuous form paper P which is long in the paper conveyance direction is wound as a recording medium, and with rotation of the conveying rollers 100, the continuous form paper P is conveyed in the paper conveyance direction.

Also, the control unit 20 acquires information on an image which a user wants to be drawn on the continuous form paper P, i.e. image information, stored in, for example, the storage unit 30, and controls the head drive unit 40 on the basis of information on the colors of individual pixels of the image, included in the image information. As a result, the head drive unit 40 drives the printing heads 50 connected to the head drive unit 40, according to ink drop ejection timings instructed from the control unit 20, thereby ejecting ink drops from the printing heads 50, such that the image corresponding to the image information is formed on the continuous form paper P which is conveyed.

Also, in the information on the colors of the individual pixels, included in the image information, information uniquely representing the pixel colors is included. In an\ example of the present exemplary embodiment, for example, the information on the colors of the pixels of the image are represented by the concentrations of yellow (Y), magenta (M), cyan (C), and black (K); however, any other method of uniquely representing the colors of the image may be used.

The printing heads 50 include four printing heads 50Y, 50M, 50C, and 50K corresponding to the four colors Y, M, C, and K, and eject ink drops having the corresponding colors from ink ejection ports formed in the printing heads 50 for the individual colors. In the example shown in FIG. 1, the case where the printing heads 50 for the individual colors are provided in the order of K, Y, C, and M along the conveyance direction is shown as an example. Also, the driving method for ejecting ink drops from the printing heads 50 is not particularly limited, and well-known schemes such as a so-called thermal scheme, a piezoelectric scheme, and so on may be applied.

Figure 1B:
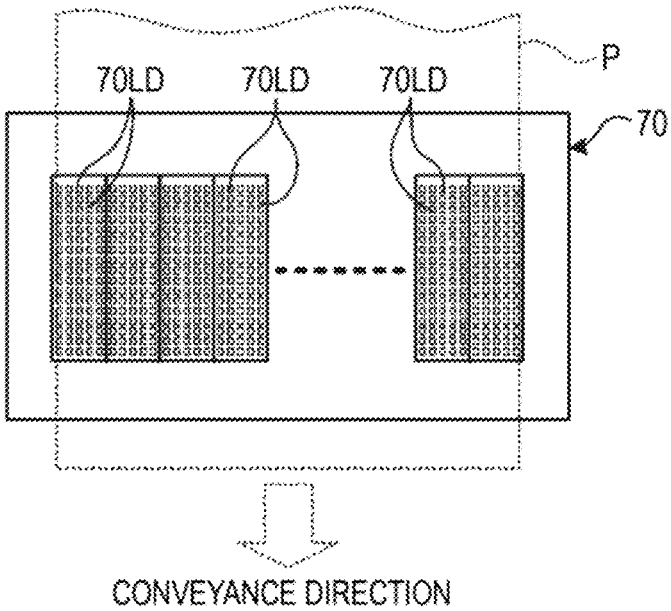

In the laser drive unit 60, switching elements (not shown in the drawings) such as FETs (Field Effect Transistors) for controlling the switching on or off of laser elements TOLD two-dimensionally arranged as the laser drying device 70 as shown in FIG. 1B are included.

In FIG. 1B, in the laser drying device 70, the laser elements TOLD are two-dimensionally arranged. However, theoretically, laser elements TOLD may be arranged in a line, at least, in a main scanning direction (a direction intersecting with the conveyance direction of the continuous form paper P (for example, at an orthogonal direction)).

The laser drive unit 60 drives the switching elements on the basis of instructions from the control unit 20, thereby adjusting average irradiation energy to be given to the continuous form paper P. The average irradiation energy is the produce of the irradiation intensity and time of laser light, and there are pulse width control and intensity control.

Pulse width control controls the duty ratios of pulses while maintaining the laser light output intensity. As the duty ratios of pulses decrease, average irradiation energy weakens; whereas as the duty ratios of pulses increase, average irradiation energy strengthens.

Intensity control controls laser light output intensity for a predetermined time. If the output intensity is low, the average irradiation energy becomes week; whereas as the output intensity is high, the average irradiation energy becomes strong.

In the present exemplary embodiment, it is assumed that the average irradiation energy is generated by pulse width control. However, even by intensity control, it is possible to generate the average irradiation energy exactly in the same way.

The control unit 20 controls the laser drive unit 60, thereby radiating laser light from the laser drying device 70 toward the image formation surface of the continuous form paper P, such that ink drops of the image formed on the continuous form paper P are dried. As a result, the image is fixed to the continuous form paper P. Also, the laser drive unit 60 and the laser drying device 70 are referred to collectively as a drying device. Also, the image formation surface means the surface of the continuous form paper P on which images are formed. Also, a region on the continuous form paper P (the image formation surface) where image formation is possible is referred to as an image formation region. In other words, an image formation region means a region on the continuous form paper P on which it is possible to form an ink image by ejecting ink drops according to an image.

Also, the distance from the laser elements of the laser drying device 70 to the continuous form paper P is set on the basis of the radiation angle and radiation region size of the laser elements.

Thereafter, with rotation of the conveying rollers 100, the continuous form paper P is conveyed to the discharging roller 90, and is wounded around the discharging roller 90.

The paper speed detection sensor 110 is disposed, for example, at a position facing the image formation surface of the continuous form paper P, and detects the conveyance speed of the continuous form paper P in the conveyance direction. The control unit 20 calculates timings to convey the ink drops ejected from the printing heads 50 onto the continuous form paper P into a laser irradiation region of the laser drying device 70, using the conveyance speed which is notified from the paper speed detection sensor 110 and the distance from the printing heads 50 to the laser drying device 70. Then, the control unit 20 controls the laser drive unit 60 such that at the timings when the ink drops on the continuous form paper P are conveyed in the laser irradiation region of the laser drying device 70, laser light is radiated from the laser drying device 70 onto the ink drops.

However, the detecting method for detecting the conveyance speed of the continuous form paper P in the paper speed detection sensor 110 is not particularly limited, and well-known methods may be applied. Also, the paper speed detection sensor 110 is not essential to the inkjet recording apparatus 10 according to the present exemplary embodiment. For example, in the case where the conveyance speed of the continuous form paper P is determined in advance, the paper speed detection sensor 110 may be unnecessary.

Also, as ink, water-based ink, oil-based ink which is ink in which a solvent evaporates, ultraviolet-curing ink, and so on exist; however, in the present disclosure, it is assumed that water-based ink is used. It is assumed that hereinafter, ink and ink drops mean water-based ink and water-based ink drops. Also, to ink of each of the colors Y, M, C, and K according to the present exemplary embodiment, an IR (infrared) absorbing agent is added to adjust the amount of laser light which the ink absorbs; however, the IR absorbing agent may not be necessarily added to the ink of each of the colors Y, M, C, and K.

As described above, the inkjet recording apparatus 10 includes the laser drying device 70 which dries the ink drops ejected onto the continuous form paper P.

(Laser Drying Device 70)

Now, the laser drying device 70 according to the present exemplary embodiment will be described.

Figure 2:
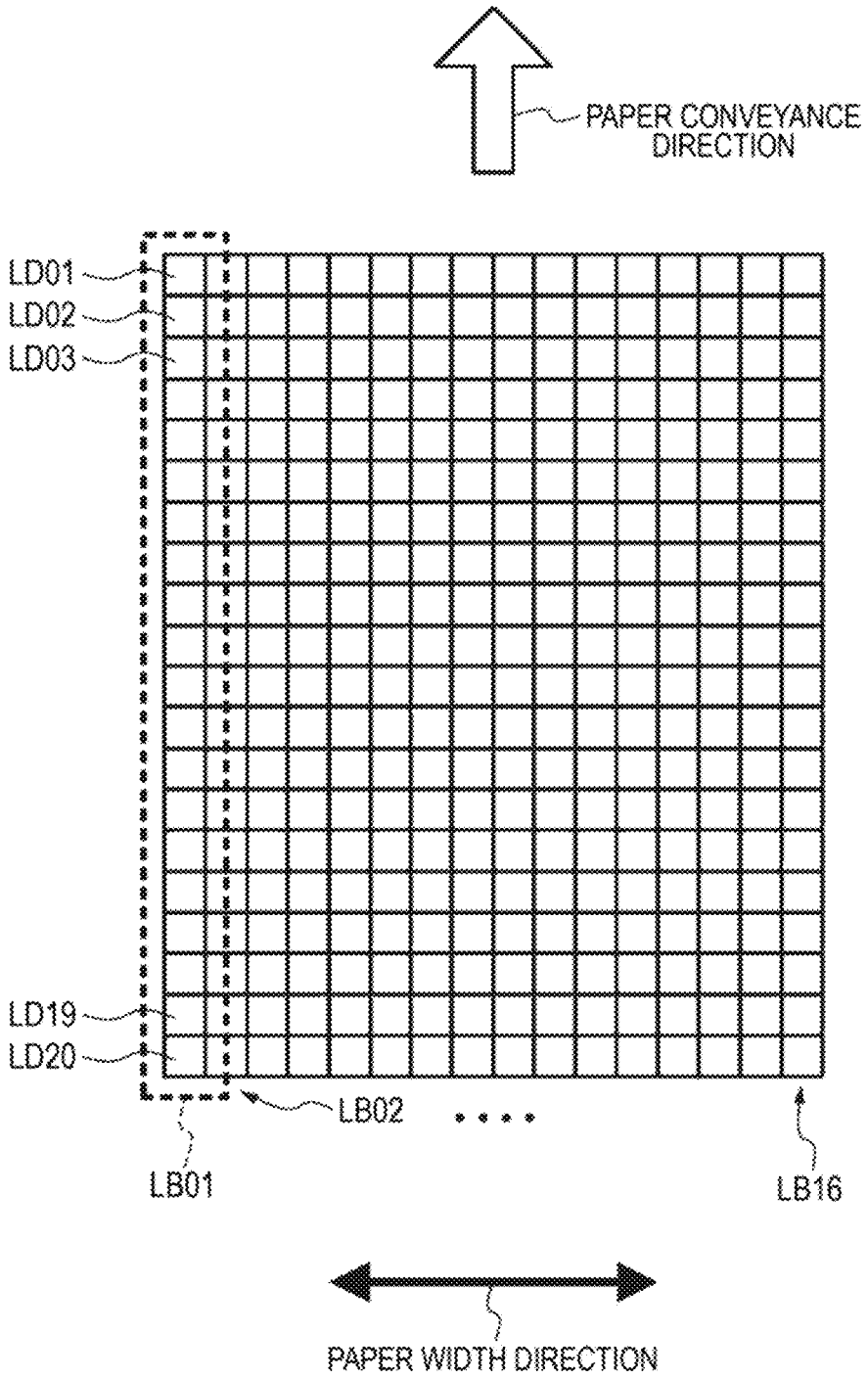
FIG. 2 is a view illustrating an example of a laser radiation surface of a laser drying device.

FIG. 2 shows an example of a laser radiation surface of the laser drying device 70. Here, the laser radiation surface means a surface on which the laser elements TOLD provided so as to face the image formation surface of the continuous form paper P radiate laser beams.

As shown in FIG. 2, on the laser radiation surface of the laser drying device 70, the laser elements TOLD are disposed along the paper conveyance direction and the paper width direction. The laser radiation timings and laser light radiation intensity of the laser elements 70LD are controlled by the laser drive unit 60. Also, the laser elements TOLD are divided into laser element blocks LB each of which has a predetermined number of laser elements, along the paper conveyance direction, and each of the laser element blocks LB is collectively driven by the laser drive unit 60. Therefore, each laser element block LB functions as a laser element group which is turned on or off at the same time.

In the example shown in FIG. 2, the case of using laser element groups each of which includes twenty laser elements 70LD01 to 70LD20, as examples of the laser elements 70LD, as the laser element blocks LB, and configuring the laser drying device 70 with 320 laser elements arranged in 16 blocks (laser element blocks LB01 to LB16) in the paper width direction is shown.

However, it goes without saying that the number of laser elements TOLD included in each laser element block LB shown in FIG. 2 and the number of laser element blocks LB are not limited. Also, in the present exemplary embodiment, the case of using laser units in which the intervals, i.e. the intervals between the laser element blocks LB have been set to 1.27 mm, as the laser elements 70LD, will be described.

As the laser elements 70LD, it is desirable to use surface-emitting laser elements which emit laser beams from surfaces. For example, as the surface-emitting laser elements, laser elements which include vertical resonator type laser elements having laser elements arranged in a grid pattern in the paper conveyance direction and the paper width direction and are also referred to as VCSELs (Vertical Cavity Surface Emitting Lasers) may be used.

(Details of Drying Control)

By the way, in the case of disposing the laser element blocks LB such that each of laser irradiation regions of the laser element blocks LB on the image formation surface of the continuous form paper P neighbors others without gaps, laser beams in units of the laser irradiation region of each laser element block LB is radiated onto the image formation surface of the continuous form paper P. However, as the laser beams, laser beams having an intensity distribution in which the intensity weakens gradually from the center is radiated. For this reason, on the image formation surface, the intensities of the laser beams vary. Therefore, unevenness in drying ink drops may occur.

For this reason, in the present exemplary embodiment, the laser element blocks LB are positioned such that laser beams overlaps each other at least in the paper width direction, such that at least image formation regions in the paper width direction are irradiated with more laser beams. In other words, the laser elements 70LD are arranged such that each of the laser beams which are radiated from the laser elements 70LD has a spread, in other words, such that at least laser beams of laser elements in the paper width direction is radiated onto the inside of each image formation region in the paper width direction so as to overlap, with a focus on the radiation angle and radiation region size of the laser elements 70LD (on the continuous form paper P.

Figure 3:
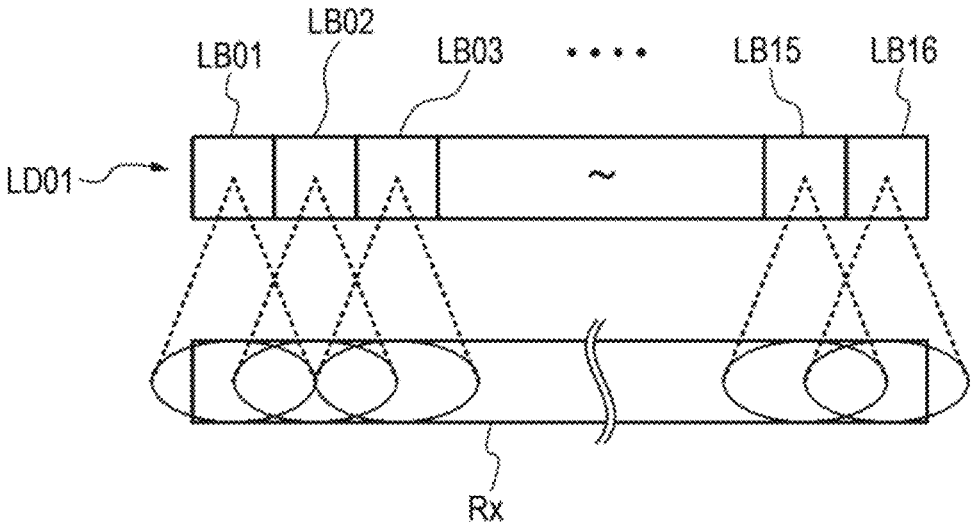
FIG. 3 is a view illustrating an example of the positional relationship between an image formation region in a paper width direction and laser element blocks.

FIG. 3 shows an example of the relationship between an image formation region in the paper width direction and the laser element blocks LB.

In the example shown in FIG. 3, the laser element blocks LB are arranged such that laser beams from the laser element blocks LB are radiated onto an image formation region Rx in the paper width direction so as to overlap. In other words, in view of the spread (radiation angle) of the laser beams of the laser elements 70LD, the distance between the laser elements 70LD and the continuous form paper P is determined such that laser beams are radiated onto the continuous form paper P so as to overlap. In this case, it is possible to disperse the laser beams to be radiated onto the continuous form paper P, from the laser beams in units of each laser element block LB into a laser beam from the laser element blocks LB. Therefore, it is possible to suppress unevenness in drying ink drops.

Also, in the case of drying ink drops using the laser drying device 70, ink drops included in the laser irradiation region of the laser drying device 70 are dried.

Therefore, in the case of dying ink drops by laser irradiation, it is necessary to consider how to set the laser irradiation region of the laser drying device 70 and how to set the laser beam intensity for the laser irradiation region.

(Setting of Average Irradiation Energy for Laser Irradiation Region)

Figure 4:
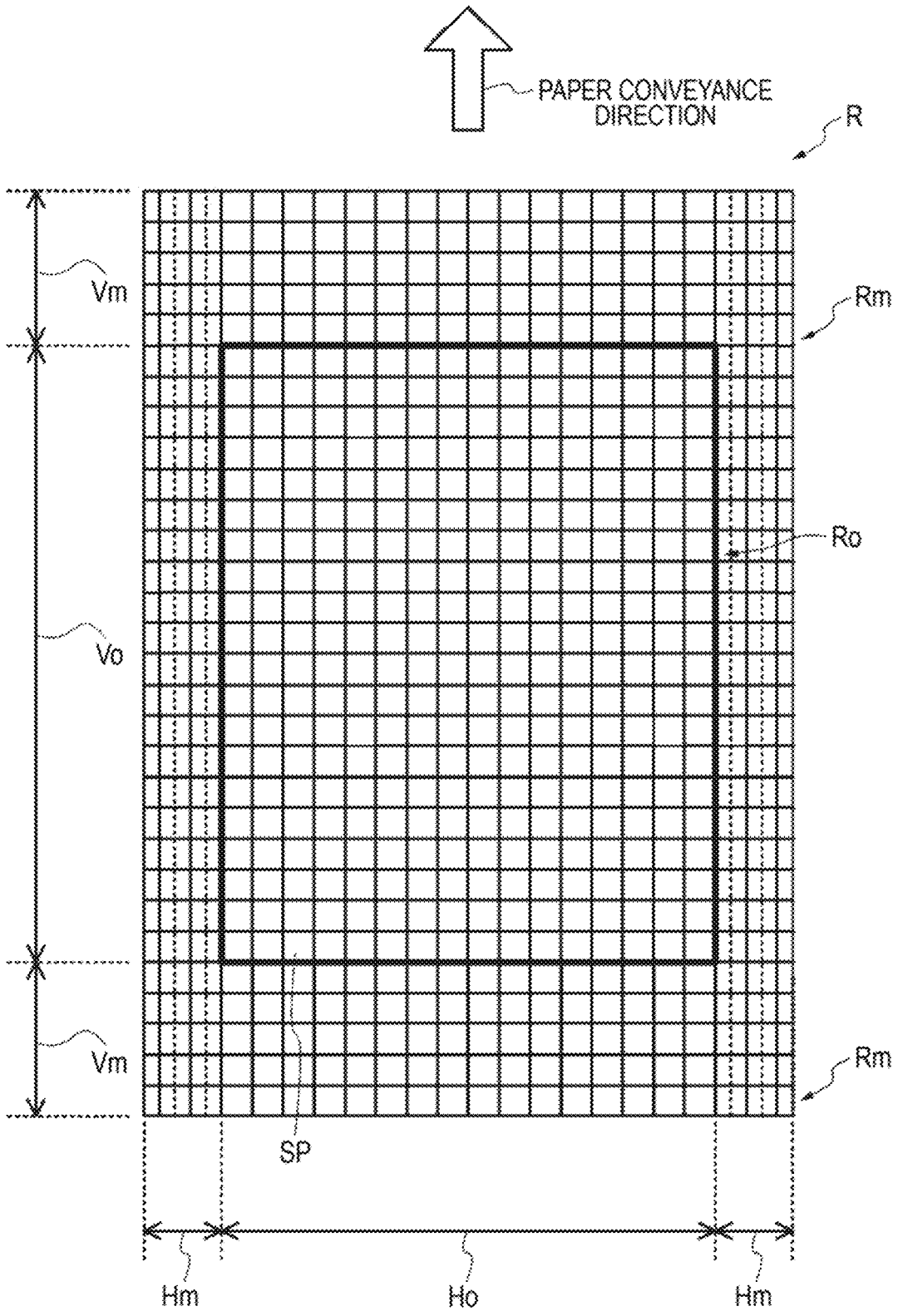
FIG. 4 is a view illustrating an example of a laser irradiation region which is irradiated by laser elements.

FIG. 4 shows an example of a laser irradiation region R which is irradiated by the laser elements 70LD.

In the present exemplary embodiment, each of the laser beams which are radiated from the individual laser elements 70LD has a spread. In order to consider the individual laser beams having the spread, the laser irradiation region R including a region Ro corresponding to the laser irradiation surface of the laser elements 70LD and a region Rm determined in view of laser beams having the spread around the region Ro is set. Also, the region Ro corresponds to the image formation region.

The region Ro is a region having a size corresponding to the laser radiation surface from which the laser elements 70LD radiates the laser beams. In other words, the region Ro is set on the continuous form paper P so as to have a width Ho corresponding to the distance of the laser elements 70LD arranged in the paper width direction, and a length Vo adjusted with reference to the distance of the laser elements 70LD arranged in the paper conveyance direction on the basis of the conveyance speed of the continuous form paper P. The continuous form paper P is irradiated with laser beams by the laser elements 70LD while being conveyed. Therefore, on the continuous form paper P, the energy of the laser beams radiated by the laser elements 70LD is accumulated. In other words, in order to dry ink drops, it is important to examine the intensity (irradiation intensity) of laser beams, and accumulative energy of the laser beams which is given for the irradiation time of the laser beams (the product of the irradiation intensity and the irradiation time is average irradiation energy). Also, in the region Ro, regions where the laser beams radiated from the individual laser elements 70LD are dominant exist.

For this reason, in the present exemplary embodiment, the region Ro is divided in units of sections corresponding to the individual laser elements 70LD, and accumulative energy which is given by the laser beams is examined for each of the sections.

In other words, in the present exemplary embodiment, the region Ro is divided into sections SP by dividing the region into 16 sections in the paper width direction (in units of a length of Ho/16) and dividing the region into 20 sections in the paper conveyance direction (in units of a length of Vo/20), and accumulative energy which is given to each section SP by the laser beams is examined. The size of the sections SP is set to the intervals between the laser elements TOLD in the paper width direction, for example, 0.635 mm. Also, the size of the sections SP in the paper conveyance direction is set to the arrangement interval of the laser elements 70LD01 to 70LD20 arranged in the paper conveyance direction, i.e. 1.89 mm.

By the way, in order to examine the accumulative energy on the region Ro, accumulative energy according to the irradiation intensity of laser beams between the laser elements TOLD in the paper width direction may be considered. In this case, the region may be divided into as many sections as a multiple of the number of laser elements TOLD arranged in the paper width direction. For example, if accumulative energies at sections corresponding to troughs of the intensity of the laser beams between the laser elements TOLD in the paper width direction are considered by dividing the region into twice as many sections as the number of laser elements 70LD, it is possible to suppress unevenness in drying. Also, if the length of each section SP in the paper conveyance direction is set to the arrangement intervals of the laser elements 70LD, it becomes unnecessary to perform calculation for regions between the arrangement intervals.

Meanwhile, as the region Rm, a region including predetermined sections is set in view of the laser beams spreading to the periphery of the region Ro. In the present exemplary embodiment, a region including a predetermined number of (for example, five) sections SP in the paper conveyance direction and including a predetermined number of (for example, five) sections having a dimension in the paper width direction which is ½ of the interval between the laser elements TOLD in the paper width direction, i.e. ½ of the dimension of each section SP in the paper conveyance direction are set. In other words, the size of the regions Rm is set by setting a width Hm corresponding to the distance of five aligned sections, each of which is half of a section SP, in the paper width direction, on both sides on the continuous form paper P, and setting a length Vm adjusted with reference to the distance of five aligned sections SP on the basis of the conveyance speed of the continuous form paper P, on the upstream side and the downstream side in the paper conveyance direction.

In the present exemplary embodiment, in order to avoid an error in calculating accumulative energy, the region Rm including the predetermined numbers of sections SP on the upstream side and the downstream side in the paper conveyance direction is set as an examination object such that it is possible to consider the influence of laser beams leaking from the region Rm due to deviation of the examination object position on the paper from the region Vo; however, at least one of the parts of the region Rm on the upstream side and the downstream side in the paper conveyance direction may be ignored. This is because a result indicating that the cumulative energy calculation result is not much influenced by such ignorance of the region Rm is obtained since the light leaking to the outside of the region Vo does not significantly contribute in a state where twenty laser elements are arranged in the paper conveyance direction at the pitch of 1.89 mm as shown in FIG. 2. By ignoring the region Rm as described above, it is possible to suppress the calculation load.

(Drive Control of Laser Drying Device 70)

Now, drive control of the laser drying device 70 will be described.

The laser drive unit 60 according to the present exemplary embodiment turns on and off the laser element blocks LB in units of each laser element block LB. Therefore, as compared to the case of collectively turning on or off all laser element blocks LB included in the laser drying device 70, it is possible to suppress wasteful laser radiation onto regions when there is no ink drop. Therefore, energy consumption required for drying ink drops is suppressed, and ink drops are efficiently dried.

Also, the laser drive unit 60 according to the present exemplary embodiment calculates the amount of ink drops (Cin) at each position on the image, using the image information. In other words, the amount of ink drops varies according to the concentration of the image to be formed on the continuous form paper P. Therefore, the laser drive unit calculate the amount of ink drops ejected onto a predetermined region on the continuous form paper P according to the image information.

The laser drive unit 60 turns on and off corresponding laser element blocks LB to obtain laser irradiation intensity according to the amount of ink drops of the image. Also, the laser drive unit 60 calculates a duty to turn on and off each laser element block LB, on the basis of the amount of the ink droplets and the conveyance speed of the continuous form paper P. In other words, the laser drive unit 60 controls the laser irradiation intensity by turning on and off the laser element blocks LB, such that necessary cumulative energy according to the amount of the ink droplets of the image is obtained in the accumulation time which is the time required for the continuous form paper P (the image formation region on the paper) to pass through the laser irradiation region in the paper conveyance direction.

(Setting of Average Irradiation Energy Based on Laser Irradiation Regions)

By the way, setting average irradiation energy on the basis of a single laser irradiation region is controlling average irradiation energy of the laser beams according to the amount (Cin) of ink drops of the image such that necessary average irradiation energy is obtained.

However, if the printing rate and the pattern size for setting average irradiation energy vary, in some regions, it may be possible to achieve a target value of wrinkling and fixing with average irradiation energy lower than the set average irradiation energy; however, such regions are irradiated with energy required to dry the other regions.

In other words, in some regions, wrinkling may be caused by excessive average irradiation energy.

For example, between the case of setting average irradiation energy when the sections SP (see FIG. 4) which are minimum units are relatively wide regions (the pattern size is large) and the case of setting average irradiation energy when the sections SP (see FIG. 4) which are minimum units are relatively narrow regions (the pattern size is small), necessary average irradiation energy may differ.

Figure 6A:
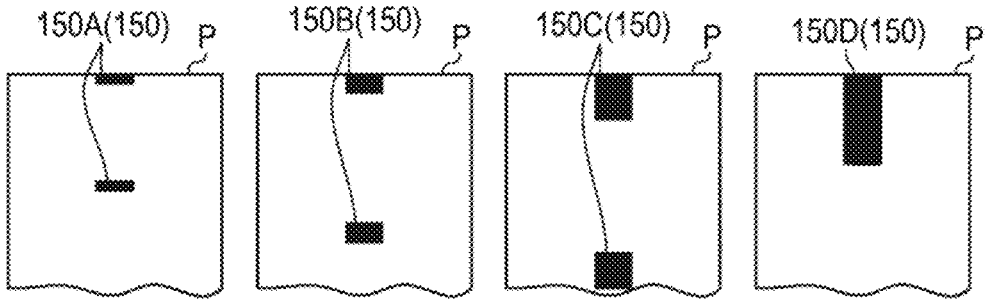
FIGS. 6A and 6B show experiment examples showing the relationship of effects of average irradiation energy according to region (pattern size) differences.
Figure 6B:
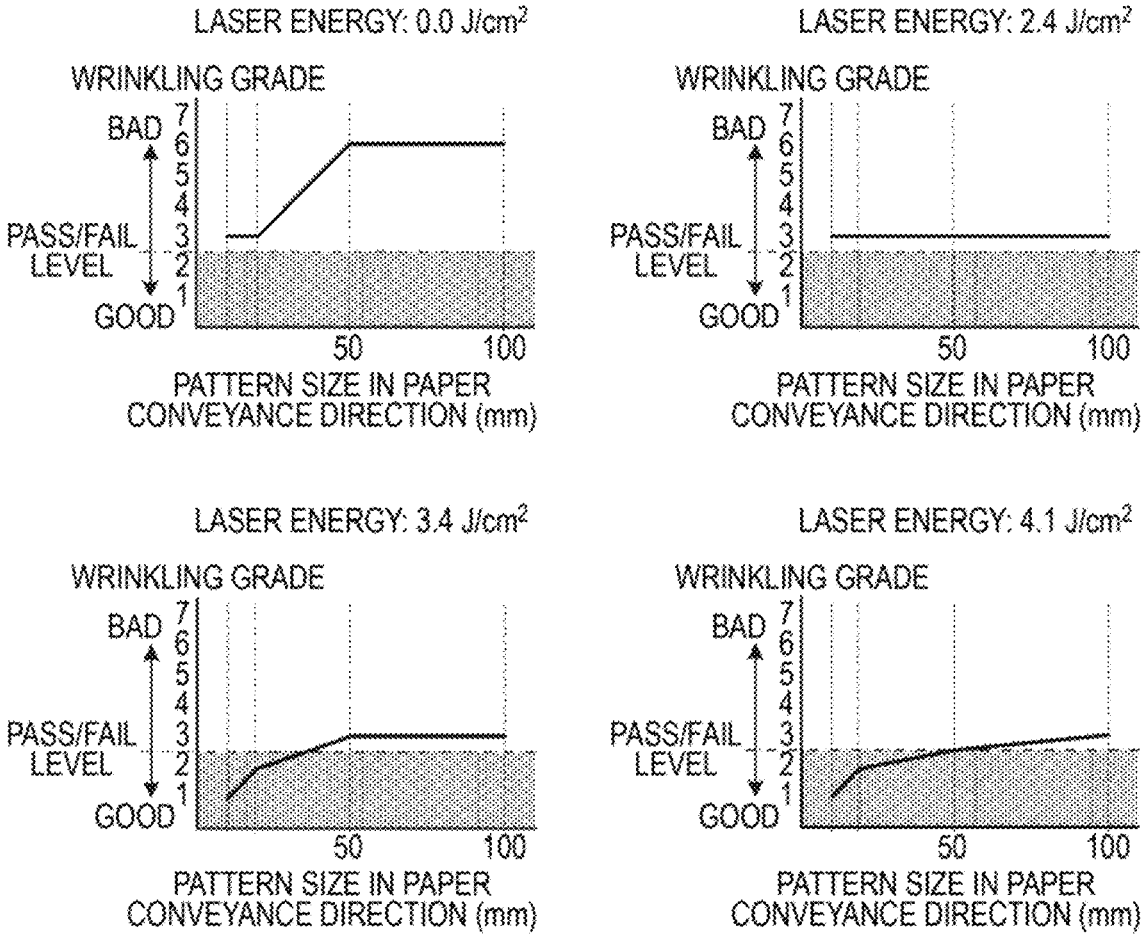

FIGS. 6A and 6B show experiment examples showing the relationships of effects (here, wrinkling grades) of average irradiation energy according to region (pattern size) differences.

As shown in FIG. 6A, as experiment objects, black solid patterns 150 having a (constant) dimension of 40 mm in the direction (width direction) perpendicular to the conveyance direction (a pattern 150A, a pattern 150B, a pattern 150C, and a pattern 150D having dimensions of 10 mm, 20 mm, 50 mm, and 100 mm in the conveyance direction, respectively) were used.

FIG. 6B shows characteristic diagrams illustrating wrinkling grades observed with respect to the individual patterns 150 by changing average irradiation energy. The average irradiation energy was set to four values, 0.0 J/cm$^2$, 2.4 J/cm$^2$, 3.4 J/cm$^2$, and 4.1 J/cm$^2$.

Also, as the value of the wrinkling grade is smaller, it is determined that it is better, and a threshold for the pass/fail level was set to Level 2.5.

According to FIG. 6B, it may be seen that average irradiation energy required to obtain a passing grade depends on the size of each pattern.

Further, it may be seen as a feature point that a pattern which is a narrow region (here, the pattern 150A) is more sensitive (more likely to react to) change of average irradiation energy than a pattern which is a wide pattern (here, the pattern 150D) is.

Figure 7A:
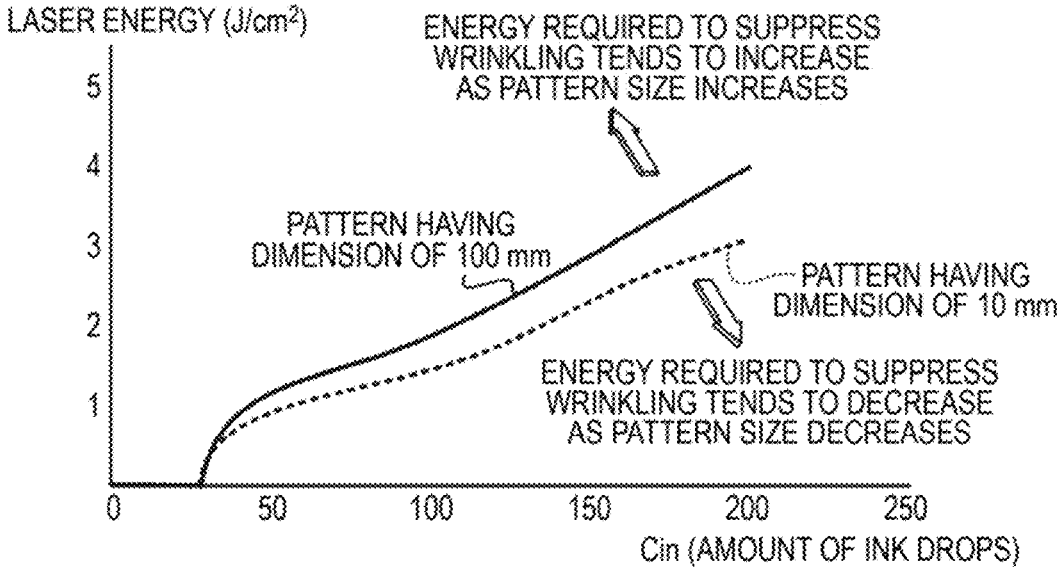
FIGS. 7A and 7B show characteristic curves illustrating the relationships between Cin (the amount of ink drops) and necessary average irradiation energy which are obtained in the cases of using a pattern whose dimension in the conveyance direction is 10 mm and a pattern whose dimension in the conveyance direction is 100 mm, shown in FIG. 6A.
Figure 7B:
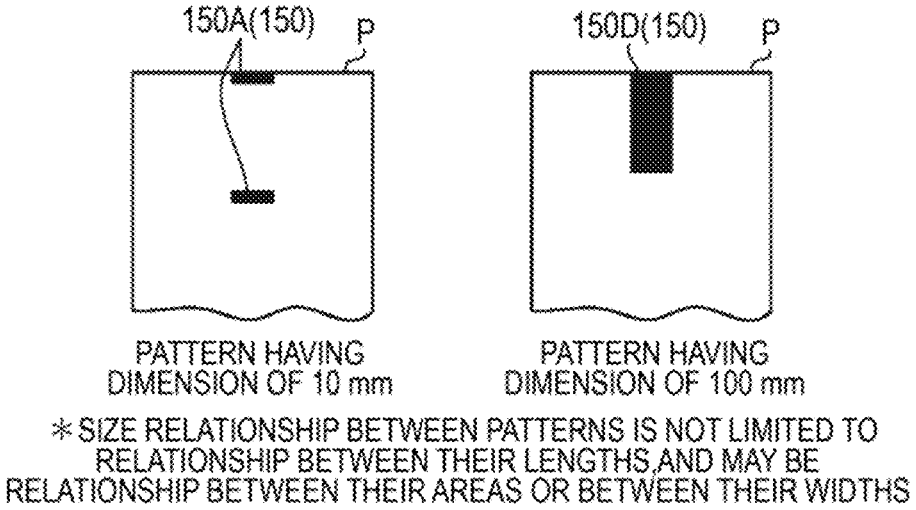

FIGS. 7A and 7B show characteristic curves illustrating the relationships between Cin (the amount of ink drops) and necessary average irradiation energy, in the cases of using the pattern 150A (having a dimension of 10 mm in the conveyance direction) and the pattern 150D (having a dimension of 100 mm in the conveyance direction) shown in FIG. 6A.

As shown in FIGS. 7A and 7B, every pattern 150 tends to require larger average irradiation energy as Cin increases; however, the corresponding value (average irradiation energy) varies. In other words, a pattern which is a region narrower than the pattern 150A having a dimension of 10 mm tends to require smaller average irradiation energy to suppress wrinkling; whereas a pattern which is a region wider than the pattern 150D having a dimension of 100 mm tends to require larger average irradiation energy to suppress wrinkling.

Due to the above-mentioned tendency, even if the printing rate is obtained by a single pattern which is a relatively wide region and average irradiation energy is set, if a printing region is not even, partially, shortage of average irradiation energy may occur.

Meanwhile, in the case of obtaining the printing rate with a single pattern which is a relatively narrow pattern and setting average irradiation energy, the difference in average irradiation energy between neighboring patterns may become too large, resulting in unevenness in drying.

Figure 8A:
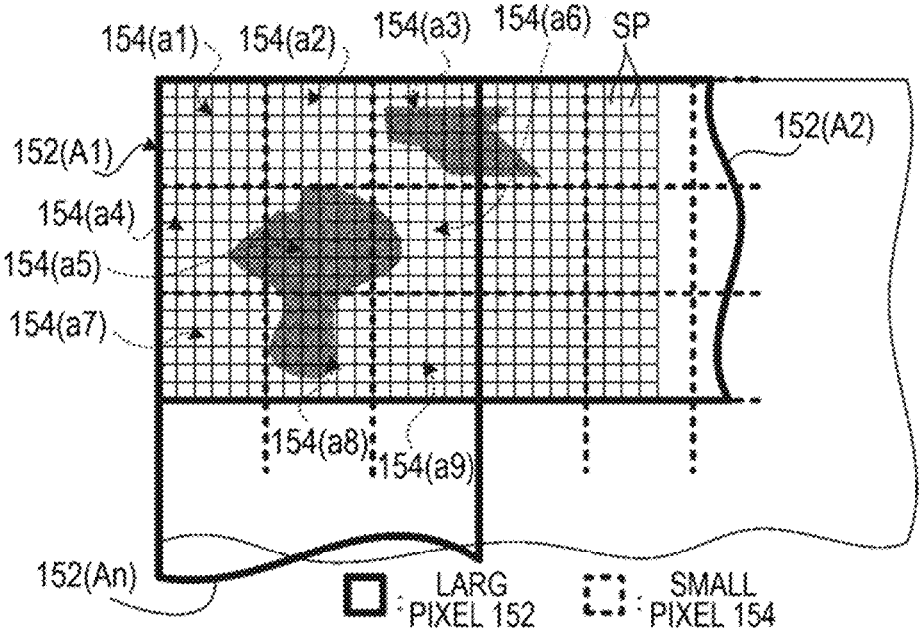
FIG. 8A is a plan view of continuous form paper P divided into regions having different sizes (large pixels and small pixels)
Figure 8B:
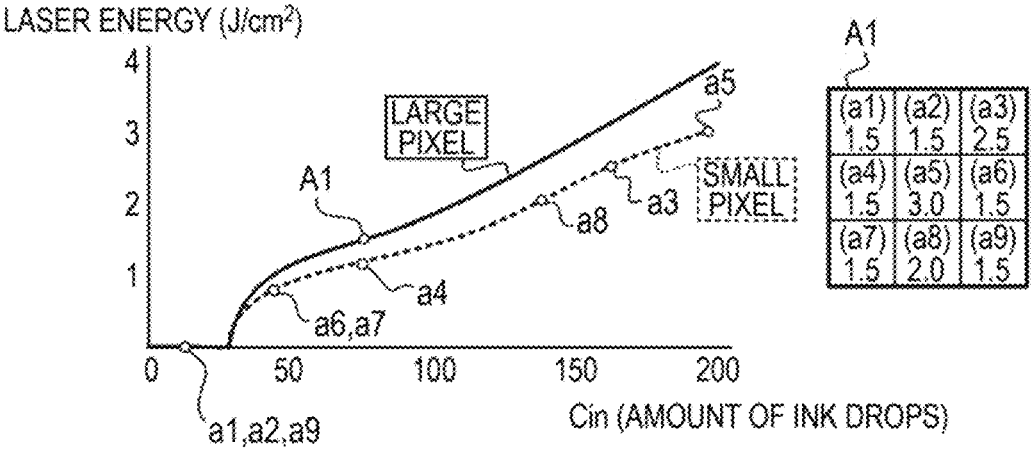
FIG. 8B shows characteristic curves illustrating the relationships between Cin and laser energy in the individual regions.

For this reason, in the present exemplary embodiment, as shown in FIGS. 8A and 8B, as divided patterns of the set of sections SP, patterns which are relatively large regions (large pixels 152) and patterns which are relatively narrow regions (small pixels 154) were set, and average irradiation energies required for the large pixels 152 according to Cin, and average irradiation energies required for the small pixels 154 according to Cin were obtained.

From the results, average irradiation energy of each small pixel 154 was determined under the following conditions.

(Condition 1) In the case where the average irradiation energy set value for each small pixels 154 is smaller than the average irradiation energy set value for a large pixel 152, the average irradiation energy set for the large pixel 152 should be adopted.

(Condition 2) In the case where the average irradiation energy set value for each small pixel 154 is larger than the average irradiation energy set value for a large pixel 152, the average irradiation energy for the corresponding small pixel should be adopted.

For example, as shown in FIG. 8A, in the same region as a large pixel 152(A1), nine small pixels 154(*a*1) to 154(*a*9) are set.

As shown in FIG. 8B, on the basis of the characteristic curves illustrating the relationships between Cin and average irradiation energy, average irradiation energies appropriate for the large pixel 152(A1) and the small pixels 154(*a*1) to 154(*a*9) are plotted.

In FIG. 8B, in the small pixels 154(*a*3), 154(*a*5), and 154(*a*8) for which average irradiation energies larger than average irradiation energy for the large pixel 152(A1) have been plotted, the plotted average irradiation energies are set, respectively. In other words, for the small pixel 154(*a*3), the small pixel 154(*a*5), and the small pixel 154(*a*8), 2.5 J/cm$^2$, 3.0 J/cm$^2$, and 2.0 J/cm$^2$ are set, respectively.

Meanwhile, in the small pixels 154(*a*1), 154(*a*2), 154(*a*4), 154(*a*6), 154(*a*7), and 154(*a*9) for which average irradiation energies smaller than the average irradiation energy for the large pixel 152(A1) have been plotted, the average irradiation energies are replaced with the average irradiation energy (here, 1.5 J/cm$^2$) plotted for the large pixel 152(A1) (Condition 2).

In other words, in the present exemplary embodiment, by adopting larger average irradiation energies in two types of different regions, during a drying process, deterioration in the quality of the image attributable to wrinkling and unevenness in drying is suppressed.

(Control Configuration of Inkjet Recording Apparatus 10)

Now, a main part configuration of an electric system of the inkjet recording apparatus 10 will be described.

Figure 5:
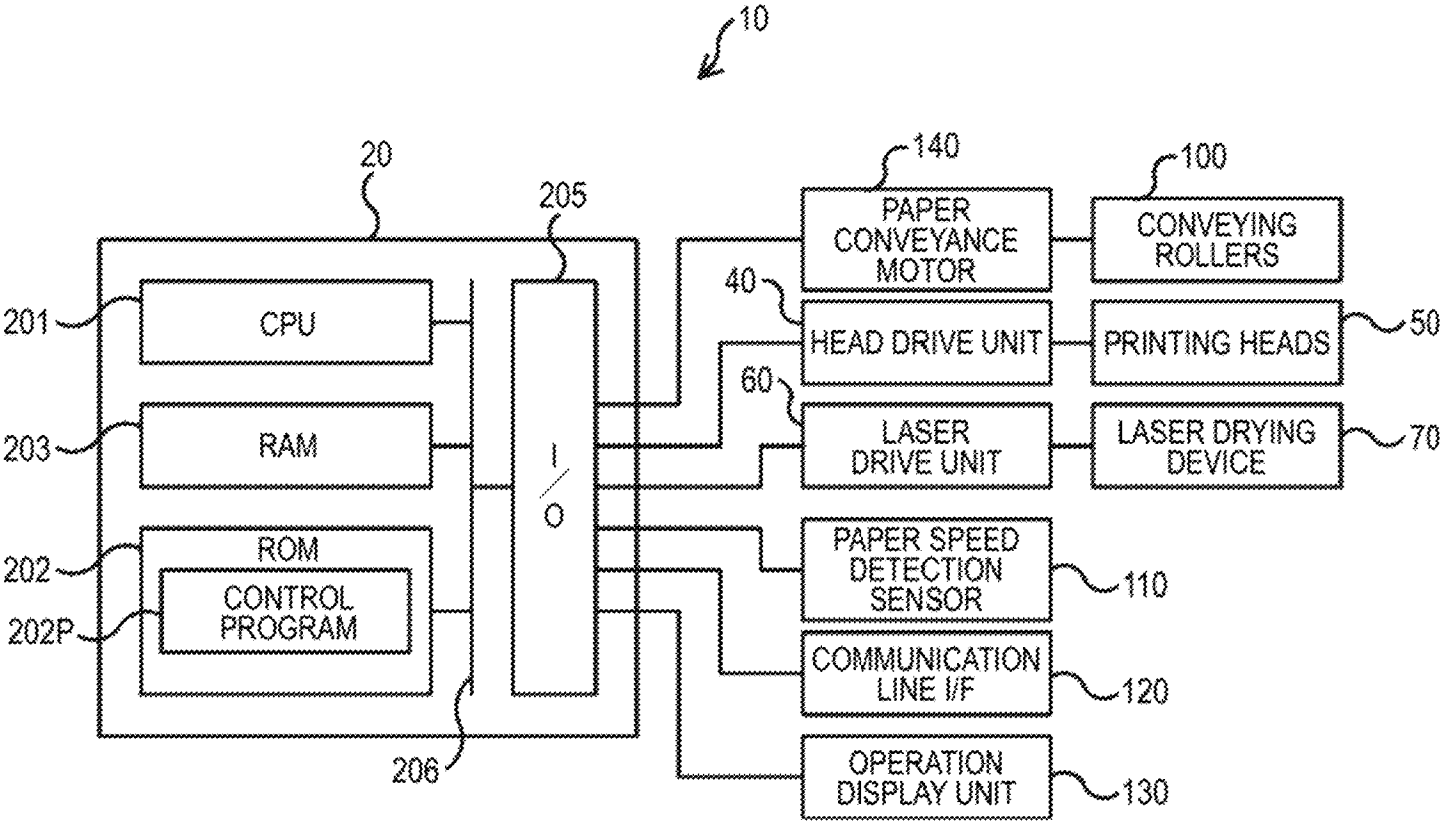
FIG. 5 is a view illustrating an example of a main part configuration of an electric system of the inkjet recording apparatus.

FIG. 5 is a view illustrating an example of the main part configuration of the electric system of the inkjet recording apparatus 10. The control unit 20 may be realized with, for example, a computer. Hereinafter, a computer which may be realized as the control unit 20 will be referred to as a computer 20, and be described.

As shown in FIG. 5, in the computer 20, a CPU (Central Processing Unit) 201, a ROM (Read Only Memory) 202, a RAM (Random Access Memory) 203, and an input/output interface (I/O) 205 are connected to one another via a bus 206. Further, to the I/O 205, the head drive unit 40, the laser drive unit 60, the paper speed detection sensor 110, a communication line I/F (interface) 120, an operation display unit 130, and a paper conveyance motor 140 are connected. Furthermore, to the head drive unit 40 and the laser drive unit 60, the printing heads 50 and the laser drying device 70 are connected, respectively. Also, the conveying rollers 100 are connected to the paper conveyance motor 140 via a drive mechanism such as gears and so on, and the conveying rollers 100 rotate with driving of the paper conveyance motor 140.

The computer 20 controls the inkjet recording apparatus 10, by executing a control program 202P installed in advance, for example, in the ROM 202, by the CPU 201, and performing data communication with elements connected to the I/O 205 according to the control program 202P.

The head drive unit 40 includes the switching elements, such as FETs and so on, for turning on or off the printing heads 50, and drives the switching elements if receiving an instruction from the computer 20.

The printing heads 50 include, for example, piezoelectric elements for converting change of voltage to a force, and so on, and operate the piezoelectric elements and so on according to drive instructions from the head drive unit 40, thereby ejecting ink drops supplied from ink tanks (not shown in the drawings) from nozzle ejection ports of the printing heads 50 toward the continuous form paper P.

The laser drive unit 60 includes, for example, switching elements such as FETs for turning on or off the laser element blocks LB included in the laser drying device 70, provided for the laser element blocks LB, respectively, and drives the switching elements if receiving instructions from the computer 20.

The laser drying device 70 includes, for example, the laser element blocks LB, and radiates laser beams from the laser element blocks LB toward the continuous form paper P, according to a drive instruction from the laser drive unit 60.

The communication line I/F 120 is an interface which may be connected to a communication line (not shown in the drawings) for performing data communication with an information device (not shown in the drawings), such as a personal computer, connected to the communication line. The communication line (not shown in the drawings) may be in any of a wired form, a wireless form, and a mixture form thereof, and may receive image information, for example, from an information device (not shown in the drawings).

The operation display unit 130 receives instructions from the user of the inkjet recording apparatus 10 and notifies the user of a variety of information related to an operation status and the like of the inkjet recording apparatus 10. The operation display unit 130 includes, for example, a touch panel display on which display buttons for realizing reception of operation instructions according to a program, and a variety of information may be displayed, and various hardware keys such as numeric keys, a start button, and so on.

Processing of the inkjet recording apparatus 10 including the above-mentioned elements may be realized in a software manner by executing the control program 202P by the computer 20.

Also, the control program 202P does not necessarily need to be provided in the form of being installed in advance in the ROM 202, and may be provided in the form of being stored in a computer-readable recording medium such as a CD-ROM, a storage unit card, or the like. Alternatively, the control program may be distributed via the communication line I/F 120.

Hereinafter, effects of the present exemplary embodiment will be described with reference to the flow chart of FIG. 9.

Figure 9:
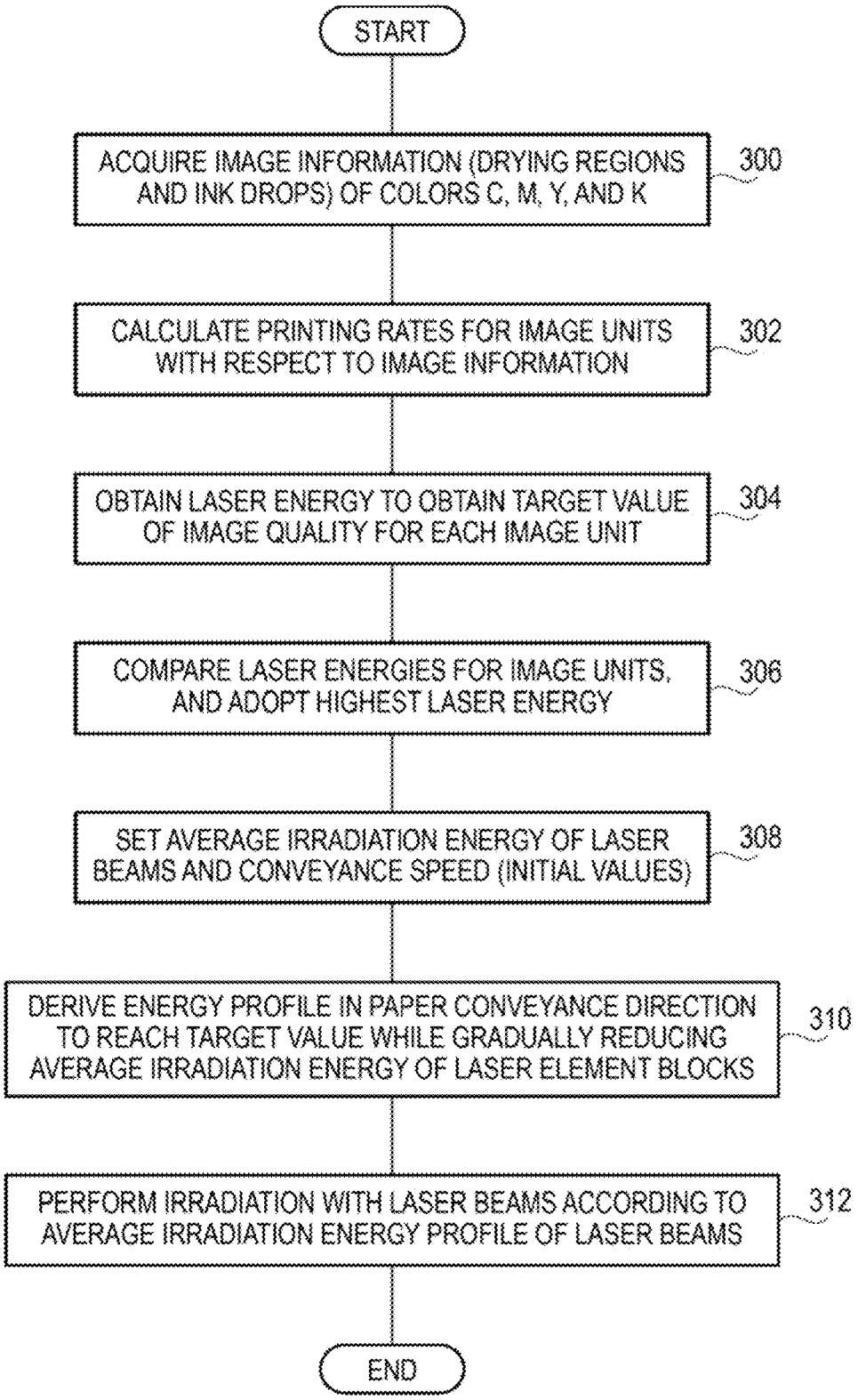
FIG. 9 is a flow chart illustrating an example of the flow of a drying process according to the exemplary embodiment.

FIG. 9 shows the flow of a drying program which is an example of the control program 202P which is executed by the CPU 201 of the computer 20 if receiving image information to be formed on the continuous form paper P from the user.

Here, in order to simplify the description, the case of collectively drying ink images of the individual colors (C, M, Y, and K) formed immediately before the laser drying device 70 will be described; however, the same control may be performed for each color.

First, in Step 300, image information of the individual colors (C, M, Y, and K) stored in advance, for example, in a predetermined area of the RAM 203 is acquired. For example, in the image information of each of the colors (C, M, Y, and K), information representing drying regions and information on the amounts of ink drops are included. The drying regions mean the positions and sizes of regions where the ink image has been formed by ink ejected onto the image formation region. Also, since the amount of ink drops varies according to the concentration of the image, for each position (for example, each pixel) in the drying regions, the amount of ink drops is determined. Therefore, the information on the amounts of ink drops is associated with the positions (for example, pixels) in the drying regions.

Subsequently, in Step 302, with respect to the image information, the printing rates in two or more regions (in the present exemplary embodiment, the large pixels 152 and the small pixels 154 shown in FIG. 8A) are calculated. Next, in Step 304, on the basis of the characteristic curves illustrating the relationships between Cin and laser energy as shown in FIG. 8B, laser energy required to dry the ink images of the individual colors (C, M, Y, and K) to be formed on the continuous form paper P (on the image formation region) is obtained in units of two or more regions.

Subsequently, in Step 306, laser energy set for a large pixel 152 and laser energy set for each small pixel 154 are compared, and higher laser energy (larger laser energy) is adopted, and the adopted laser energy is stored as a target value in the RAM 203.

Next, in Step 308 and Step 310, from the laser energy target value for a specific position in the paper conveyance direction, average irradiation energy is calculated by repeated operations. First, in Step 308, in order to derive average irradiation energy to be radiated by the laser drying device 70, initial values of the average irradiation energy of the laser beams and the conveyance speed are set on the basis of the maximum irradiation intensity of the laser beams to be radiated from the laser element blocks LB, for example, at the maximum duty, and the conveyance speed at which the continuous form paper P is conveyed in the paper conveyance direction. Here, it is assumed that as the conveyance speed, a predetermined conveyance speed for conveying the continuous form paper P in the inkjet recording apparatus 10 is stored in advance.

Subsequently, in Step 310, an energy profile in the paper width direction is derived to reach the target value while the average irradiation energy of the laser element TOLD is gradually reduced by repeated operations while preventing the average irradiation energy from falling below the target average irradiation energy.

In the present exemplary embodiment, since twenty laser elements are aligned in the paper conveyance direction, and they are collectively controlled, the operation for deriving the average irradiation energy required to dry the ink image of each of the colors (C, M, Y, and K) is significantly simplified by assuming the same value in the paper conveyance direction and performing one-dimensional calculation only in the paper width direction, instead of performing two-dimensional calculation. The average irradiation energy in the one-dimensional direction is derived in the paper width direction with respect to the ink image of each of the colors (C, M, Y, and K), and is developed in the paper conveyance direction.

Next, in Step 312, each of the laser element blocks LB is driven according to each of average irradiation energy profiles PwP derived in the above-described way. Then, the program is ended.

According to the present exemplary embodiment, the drying region of the continuous form paper P to be dried by the laser drying device 70 is divided into the sections SP, and as sets of sections SP, the large pixels 152 and the small pixels 154 are set, and average irradiation energy required for each of the pixels according to Cin is obtained. In the case where the average irradiation energy set value for a small pixel 154 is smaller than the average irradiation energy set value for a large pixel 152, the average irradiation energy set for the large pixel 152 is adopted. Meanwhile, in the case where the average irradiation energy set value for a small pixel 154 is larger than the average irradiation energy set value for a large pixel 152, the average irradiation energy set for the corresponding small pixel 154 is adopted. The average irradiation energy for each small pixel 154 is determined in the above-mentioned way. Therefore, occurrence of writing attributable to swelling and contracting of non-image sections and image sections decreases.

Also, in the present exemplary embodiment, calculation of the average value of Cin is performed in regions (the large pixels 152 and the small pixels 154) set like so-called tiles; however, the same calculation may be performed by calculating methods called moving average or weighted average.

Also, the present invention is not limited to two types of pixels, i.e. the large pixels 152 and the small pixels 154, and three or more types of pixels having different sizes may be set. With increase in the number of different sizes, the number of characteristic curves of FIG. 8B increases.

(First Modification)

Figure 10A:
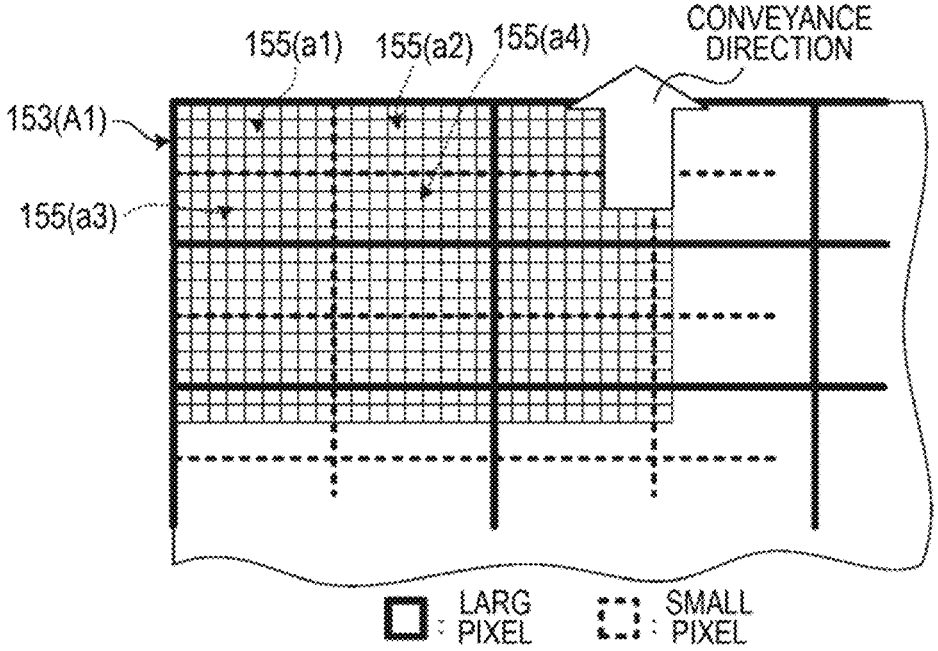
FIGS. 10A and 10B are related to a first modification, and are plan views illustrating continuous form paper P divided into regions having different sizes (large pixels and small pixels)
Figure 10B:
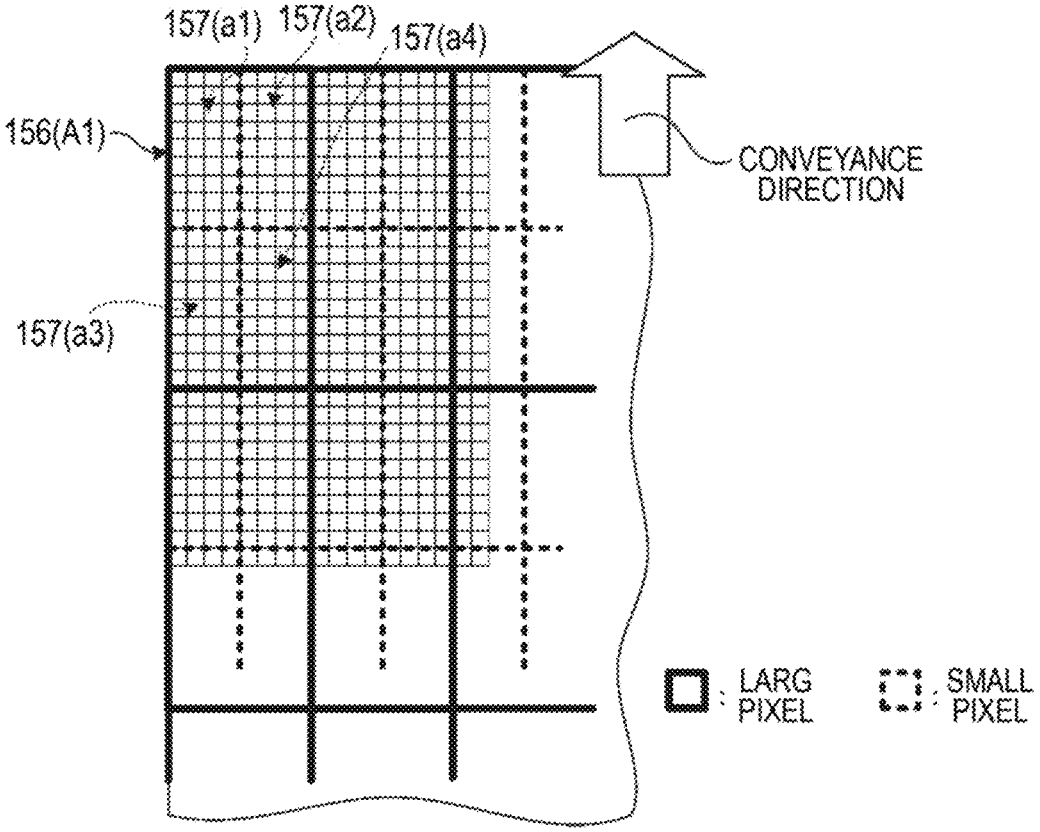

Also, in the present exemplary embodiment, the large pixels 152 and the small pixels 154 (see FIG. 8A) are set in square shapes; however, as shown in FIG. 10A, large pixels 153 and small pixels 155 having rectangular shapes having long sides in the direction perpendicular to the conveyance direction may be used, or as shown in FIG. 10B, large pixels 156 and small pixels 157 having rectangular shapes having long sides in the conveyance direction may be used.

(Second Modification)

Figure 11A:
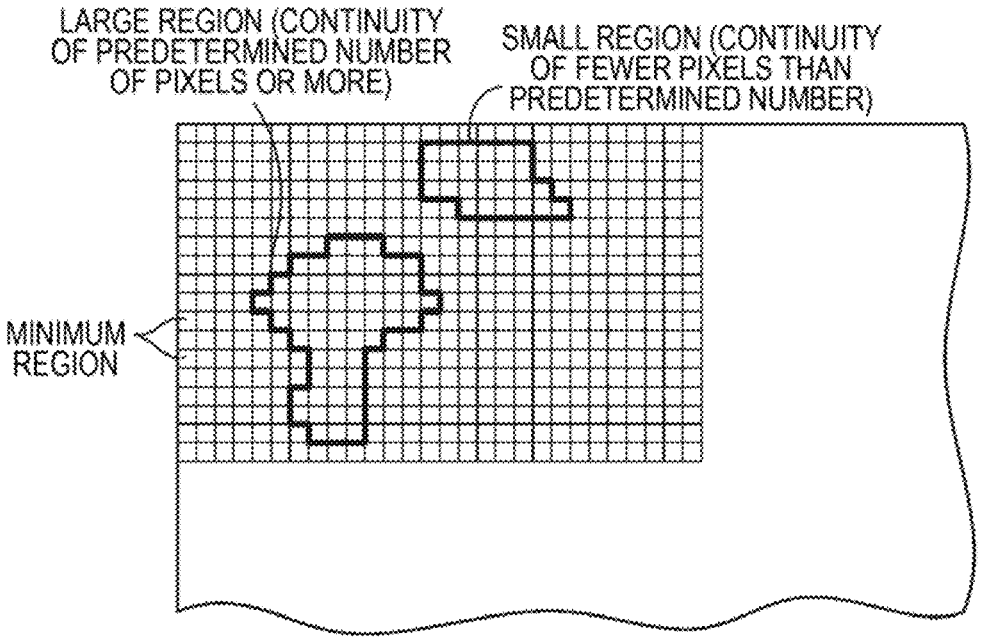
FIGS. 11A and 11B are related to a second modification.

Also, in the present exemplary embodiment, the large pixels 152 and the small pixels 154 are set uniformly; however, as shown in FIG. 11A, image regions and non-image regions may be classified by a labeling algorithm.

In other words, of classified image regions, regions having areas equal to or larger than a predetermined area are set as large regions, and regions having areas smaller than the predetermined area are set as small regions, and unit sections of non-image regions are set as minimum sections.

Figure 11B:
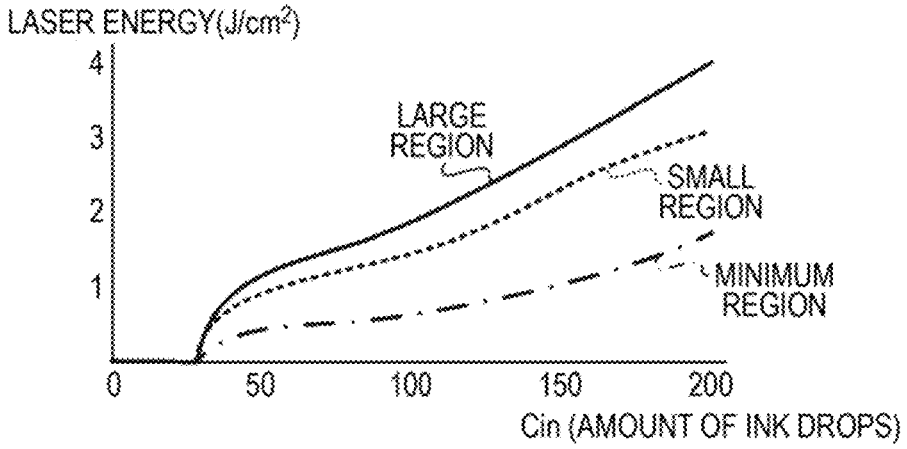

As shown in FIG. 11B, characteristic curves representing the relationships between Cin and laser energy in individual regions are plotted, and average irradiation energies are set.

The flow of processing of the second modification will be described with reference to the flow chart of FIG. 12. With respect to steps in which the same processes as those of FIG. 9 are performed, "A" is added to the ends of their reference symbols.

First, in Step 300A, image information of the individual colors (C, M, Y, and K) stored in advance, for example, in a predetermined area of the RAM 203 is acquired. For example, in the image information of each of the colors (C, M, Y, and K), information representing drying regions and information on the amounts of ink drops are included. The drying regions mean the positions and sizes of regions where the ink image has been formed by ink ejected onto the image formation region. Also, since the amount of ink drops varies according to the concentration of the image, for each position (for example, each pixel) in the drying regions, the amount of ink drops is determined. Therefore, the information on the amounts of ink drops is associated with the positions (for example, pixels) in the drying regions.

Subsequently, in Step 314, on the basis of a predetermined threshold, a binary image is created. Then, in Step 316, region estimation is performed by a four-neighborhood labeling algorithm. As a result, basically, image regions and non-image regions are classified, and image regions are classified into large regions and small regions, and unit sections of the non-image regions are set as minimum sections.

Next, in Step 316, on the basis of FIG. 11B, average irradiation energy is determined. Then, the processing proceeds to Step 308A.

Subsequently, in Step 308A and Step 310A, from the laser energy target value for a specific position in the paper conveyance direction, average irradiation energy is calculated by repeated operations. First, in Step 308A, in order to derive average irradiation energy to be radiated by the laser drying device 70, initial values of the average irradiation energy of the laser beams and the conveyance speed are set on the basis of the maximum irradiation intensity of the laser beams to be radiated from the laser element blocks LB, for example, at the maximum duty, and the conveyance speed at which the continuous form paper P is conveyed in the paper conveyance direction. Here, it is assumed that as the conveyance speed, a predetermined conveyance speed for conveying the continuous form paper P in the inkjet recording apparatus 10 is stored in advance.

Subsequently, in Step 310A, an energy profile in the paper width direction is derived to reach the target value while the average irradiation energy of the laser element 70LD is gradually reduced by repeated operations while preventing the average irradiation energy from falling below the target average irradiation energy.

In the present exemplary embodiment, since twenty laser elements are aligned in the paper conveyance direction, and they are collectively controlled, the operation for deriving the average irradiation energy required to dry the ink image of each of the colors (C, M, Y, and K) is significantly simplified by assuming the same value in the paper conveyance direction and performing one-dimensional calculation only in the paper width direction, instead of performing two-dimensional calculation. The average irradiation energy in the one-dimensional direction is derived in the paper width direction with respect to the ink image of each of the colors (C, M, Y, and K), and is developed in the paper conveyance direction.

Next, in Step 312A, each of the laser element blocks LB is driven according to each of average irradiation energy profiles PwP derived in the above-described way. Then, the program is ended.

(Third Modification)

In the second modification, when the binary image is created, the regions are classified by the single threshold (a Cin value representing the amount of ink drops); however, different binary images may be created using two or more thresholds (Cin values re-printing the amounts of ink drops), and in each of the binary images, region estimation may be performed by a labeling algorithm.

Figure 12:
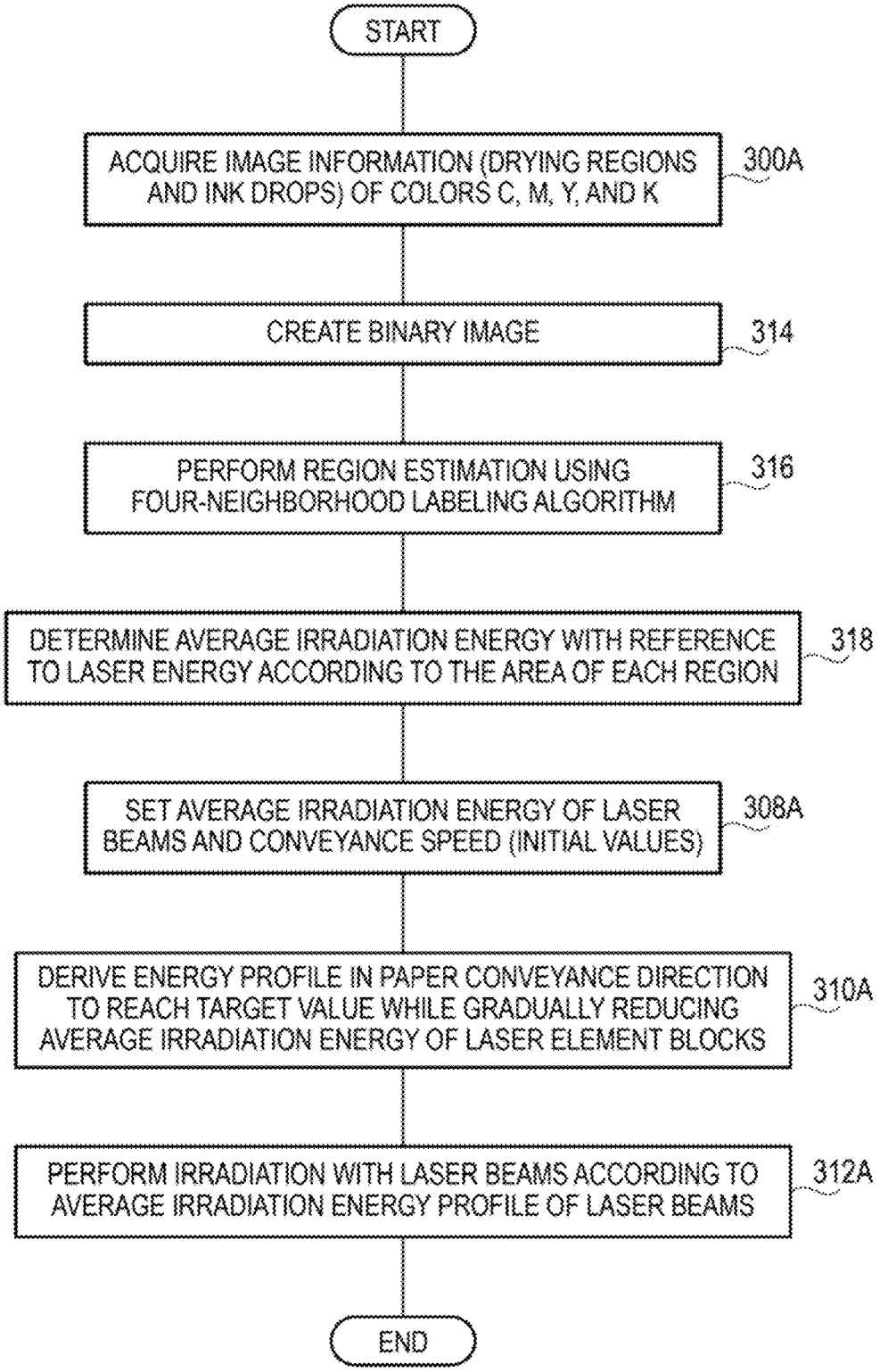
FIG. 12 is a flow chart illustrating an example of the flow of a drying process according to the second modification.
Figure 13:
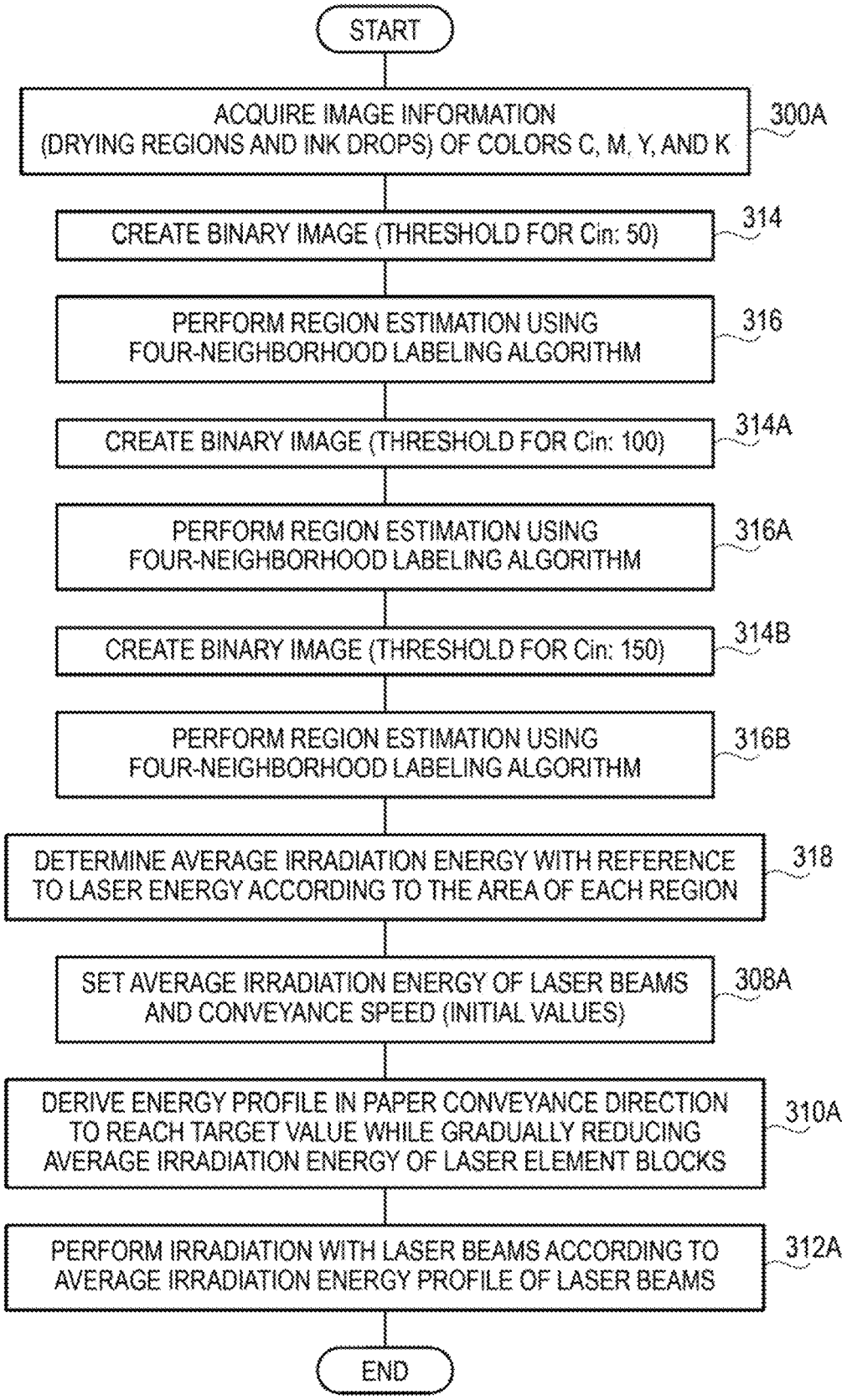
FIG. 13 is a flow chart illustrating an example of the flow of a drying process according to a third modification.

For example, in the flow of processing, as shown in the flow chart of FIG. 13, as thresholds (Cin values representing the amounts of ink drops) for creating binary images, 50 (=Cin), 100 (=Cin), and 150 (=Cin) are set, and the processes of Steps 314 and 316 of the processing of the flow chart of FIG. 12 are repeated with respect to the different Cin values (see Steps 314A, 316A, 314B, and 316B of the flow chart of FIG. 13).

Also, in the second modification and the third modification, as the labeling algorithm, the four-neighborhood labeling algorithm is used; however, an eight-neighborhood labeling algorithm or a method of binding connected sections using a histogram may be applied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drying device comprising:

a plurality of laser elements that controls energies of laser beams to be radiated, and radiates laser beams onto predetermined regions of an image, respectively; and a controller that controls average irradiation energy of laser beams by calculating printing rates for a plurality of types of divided patterns with respect to the regions of the image, and calculating energy required to dry, for each divided pattern, based on the printing rates calculated for individual divided patterns, and selecting energy to be adopted according to a purpose, from the energy calculated for the individual divided patterns.

2. The drying device according to claim 1, wherein:

the plurality of types of divided patterns set minimum unit regions of the image, and the plurality of types of divided patterns is set according to the numbers of minimum unit regions included in the divided patterns and the differences between selected positions.

3. The drying device according to claim 2, wherein:

the plurality of types of divided patterns is set so as to have at least one difference of a difference between the shapes of the divided patterns, a difference between the aspect ratios of the divided patterns, and a difference between the minimum unit regions which are selected on the basis of a labeling algorithm.

4. The drying device according to claim 2, wherein:

in a selection of the energy, from the calculated energies, the maximum energy is selected.

5. The drying device according to claim 2, wherein:

in a selection of the energy, from the calculated energies, the minimum energy is selected.

6. The drying device according to claim 2, wherein:

in a selection of the energy, weights are set for a quality of an image which is printed and an energy saving, and the energy is selected from a plurality of calculated energies, according to the weights.

7. The drying device according to claim 2, wherein:

the average irradiation energy of the laser beams is controlled by intensity modulation control, pulse width modulation control, or a combination thereof.

8. The drying device according to claim 3, wherein:

in a selection of the energy, from the calculated energies, the maximum energy is selected.

9. The drying device according to claim 3, wherein:

in a selection of the energy, from the calculated energies, the minimum energy is selected.

10. The drying device according to claim 3, wherein:

in a selection of the energy, weights are set for a quality of an image which is printed and an energy saving, and the energy is selected from a plurality of calculated energies, according to the weights.

11. The drying device according to claim 3, wherein:

the average irradiation energy of the laser beams is controlled by intensity modulation control, pulse width modulation control, or a combination thereof.

12. The drying device according to claim 1, wherein:

in a selection of the energy, from the calculated energies, the maximum energy is selected.

13. The drying device according to claim 12, wherein:

the average irradiation energy of the laser beams is controlled by intensity modulation control, pulse width modulation control, or a combination thereof.

14. The drying device according to claim 1, wherein:

in a selection of the energy, from the calculated energies, the minimum energy is selected.

15. The drying device according to claim 14, wherein:

the average irradiation energy of the laser beams is controlled by intensity modulation control, pulse width modulation control, or a combination thereof.

16. The drying device according to claim 1, wherein:

in a selection of the energy, weights are set for a quality of an image which is printed and an energy saving, and the energy is selected from a plurality of calculated energies, according to the weights.

17. The drying device according to claim 16, wherein:

the average irradiation energy of the laser beams is controlled by intensity modulation control, pulse width modulation control, or a combination thereof.

18. The drying device according to claim 1, wherein:

the average irradiation energy of the laser beams is controlled by intensity modulation control, pulse width modulation control, or a combination thereof.

19. A non-transitory computer readable medium storing a program causing a computer to execute a process for drying as individual units of the drying device according to claim 1.

20. An image forming apparatus comprising:

an ejecting unit that ejects ink drops onto a recording medium according to image information;

a conveying unit that conveys the recording medium;

the drying device according to claim 1; and a controller that controls the ejecting unit, the conveying unit, and the drying device.

* * * * *